US006364545B1

(12) United States Patent
Horn et al.

(10) Patent No.: US 6,364,545 B1
(45) Date of Patent: Apr. 2, 2002

(54) PHOTOGRAPHIC PROCESSOR HAVING AN IMPROVED REPLENISHMENT DELIVERY SYSTEM

(75) Inventors: Richard R. Horn, Fairport; Faye Transvalidou, Rochester; Daniel C. Davis, Rush, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/779,276

(22) Filed: Feb. 8, 2001

(51) Int. Cl.[7] ..... G03D 3/02; G03D 13/00
(52) U.S. Cl. ..... 396/578; 346/626; 137/565.33
(58) Field of Search ..... 396/626, 636, 396/578; 137/386, 391, 406, 523, 565.33, 571

(56) References Cited

U.S. PATENT DOCUMENTS

| | | | | |
|---|---|---|---|---|
| 4,263,587 A | | 4/1981 | John | 340/620 |
| 4,466,072 A | | 8/1984 | Kaufmann | 396/570 |
| 4,474,444 A | | 10/1984 | Penchenier | 396/573 |
| 4,742,244 A | | 5/1988 | Koerner | 340/620 |
| 5,151,731 A | * | 9/1992 | Yamada et al. | 396/626 |
| 5,357,306 A | | 10/1994 | Skye et al. | 396/63 D |
| 5,432,583 A | * | 7/1995 | Ishikawa et al. | 396/626 |
| 5,577,614 A | | 11/1996 | Palmeroni, Jr. et al. | 206/521 |
| 5,694,991 A | | 12/1997 | Harris et al. | 141/346 |
| 5,749,018 A | | 5/1998 | Wess et al. | 396/578 |

* cited by examiner

*Primary Examiner*—D Rutledge
(74) *Attorney, Agent, or Firm*—Frank Pincelli

(57) ABSTRACT

A delivery system and method for delivering a processing solution to a processing tank in a processor containing a processing solution. The delivery system is designed to provide a replenishment solution to the processing tank from a package having at least two separate containers. Each of the containers having a processing solution that is to be provided to the at least one processing tank. The delivery system substantially empties each of the at least two separate containers in the package in an accurate predetermined rate so that all of the at least two containers in the package will be substantially empty at the same time. The delivery system includes a mechanism for filling and emptying the predetermined amount of replenishment solution from the retaining vessel in response to the liquid level sensing system.

22 Claims, 5 Drawing Sheets

PHOTOGRAPHIC PROCESSOR HAVING AN IMPROVED REPLENISHMENT DELIVERY SYSTEM

FIELD OF THE INVENTION

The present invention is directed to photographic processors and more particularly to a replenishment system for accurately delivering replenishment solution from a package containing a plurality of discrete containers to the processing tanks.

BACKGROUND OF THE INVENTION

In many retail establishments there is provided a small mini-lab processor which is used for the processing of film. In such processors, it has been desirable to provide the replenishment solution used for replenishing the processing solutions in the processing tanks to be provided in a combined shipping and dispensing package such as illustrated in U.S. Pat. No. 5,577,614 which is hereby incorporated by reference. This type of package allows a low skill operator of the processing apparatus to quickly and easily provide fresh replenishment solution to the apparatus. Typically, the package has a plurality of individual containers, each having a different processing solution of different amounts that are designed to be emptied all at the same time such that a fresh package can be placed without any waste of processing solution. If too much remaining solution is left in any one of the containers this can present a problem with regard to appropriate disposal of the processing solution remaining therein.

In order to try to improve the emptying of all the containers at the same time, it has been suggested the providing of more accurate feed pumps for delivery of the processing solutions from the package to the processing tanks so that the appropriate amount of processing solution is delivered. While this has provided improvement, this solution is relatively expensive. An additional problem with current processors it that they do not provide any feedback to the operator if there is pump malfunction. The fluid flow or replenishment volume is not measured anywhere in the replenishment delivery system. Typically, the pumps are concealed and the customer has no visual indication of the amount of the replenishment solution delivered. It is assumed that the pumps are always delivering their normal predefined amount. With normal use and wear the pumps will eventually fail without providing a warning to the operator. In addition, there exists the possibility that over time these pumps due to normal wear and tear will eventually fail or become less accurate.

Prior art devices have also suggested various techniques for determining when the containers have been emptied. One such system relies on the placement of a sensor adjacent to the neck of the container and uses this information to determine when the container is empty. Typically, these rely on a collar that is moved in response to the position of the fluid contained therein. When empty, the collar goes to a position that activates the sensor to advise that the container is empty. Occasionally, defects in container manufacturing may cause the floating collar to stick and fail to drop when the package is empty. In other situations, a false empty alarm may be activated due to sensor failure or when the sensors are in need of cleaning or maintenance. An example of use of such sensors are disclosed in U.S. Pat. No. 5,694,991 which is hereby incorporated herein by reference in it's entirety.

The prior art has also disclosed the use of calibrated vessels for metering a desired amount of processing solution in large scale processing system. An example of such units are the Hostert Fotomata Inline/ED 15 replenishment unit found on Model DDP40/120 E6 processor and the Gretag Model E6-120 GL/VESS E-6 processor. These systems are directed to supplying processing solution from a single large supply container into an associated processing tank. These systems are operated in a continuous manner. When the solution in the supply container reaches a low level, a skilled attendant would simply provide more solution to the supply vessel. Packaged chemistry is not suitable for such systems nor is there any concern for associating the refilling of one supply vessel with another supply vessel in these systems.

Thus, there is a need to provide an accurate and economical fluid delivery system for providing replenishment solutions to photographic processors which utilize a replenishment package system having two or more processing solutions that are to be depleted simultaneously.

The present invention provides an accurate delivery system at relatively low costs without the need for expensive metering pumps to dispense the solution and also provides the ability to detect delivery problems in an easier manner than previously allowed. The present invention also provides a delivery system that does not rely on pumps for determining the amount of fluid that has been delivered and once calibrated the amount of solution delivered over time does not change. The present invention further allows a visual indication that a predetermined amount of replenishment solution has been delivered.

SUMMARY OF THE INVENTION

In accordance with one aspect of the present invention there is provided a photographic processor, comprising:

a processing tank for containing a processing solution through which a media is passed for processing of a media;

a delivery system for providing a replenishment solution to the processing tank from a package having at least two separate containers, each of the containers having a processing solution that is to be provided to the at least one processing tank, the delivery system substantially emptying each of the at least two separate containers in the package in an accurate predetermined rate so that all of the at least two containers in the package will be substantially empty at the same time, the delivery system having a retaining vessel, a liquid level sensing system for sensing a predetermined amount of the replenishment solution in the retaining vessel to be delivered to the processing tank, a delivery mechanism for filling and emptying the predetermined amount of replenishment solution from the retaining vessel in response to the liquid level sensing system.

In accordance with another aspect of the present invention there is provided a method for delivering a replenishment solution to a processing tank in a photographic processor having at least one processing tank and is designed to provide replenishment solution to the at least one processing tank from a package having a plurality of containers each having a processing solution therein, comprising the steps of:

dispensing the processing solutions from each of the containers into an associated retaining vessel until a signal to stop is received; and dispensing a predetermined amount of the processing solution from the retaining vessel for delivery to one of the processing tanks.

In accordance with yet another aspect of the present invention there is provided a photographic processor, comprising:

a plurality of processing tanks for containing a processing solution through which a media is passed for processing of a media;

a delivery system for providing a replenishment solution to the plurality of processing tanks from a package having at least two separate containers, each of the containers having a processing solution that is to be provided to one of the plurality of processing tanks, the delivery system substantially emptying each of the at least two separate containers in the package in an accurate predetermined rate so that the at least two containers in the package will be substantially empty at the same time, the delivery system having a retaining vessel, a liquid level sensing system for sensing a predetermined amount of the replenishment solution in the retaining vessel, a delivery mechanism for filling and emptying the predetermined amount of replenishment solution from the retaining vessel in response to the liquid level sensing system.

In accordance with still another aspect of the present invention, there is provided a delivery system for providing a replenishment solution to one or more processing tanks from a package having at least two separate containers, each of the containers having a processing solution that is to be provided to the one or more processing tanks, the delivery system substantially emptying each of the at least two separate containers in the package in an accurate predetermined rate so that all of the at least two containers in the package will be substantially empty at the same time, the delivery system having a retaining vessel, a liquid level sensing system for sensing a predetermined amount of the replenishment solution in the retaining vessel to be delivered to the one or more processing tanks, a delivery mechanism for filling and emptying the predetermined amount of replenishment solution from the retaining vessel in response to the liquid level sensing system.

These and other aspects, objects, features, and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
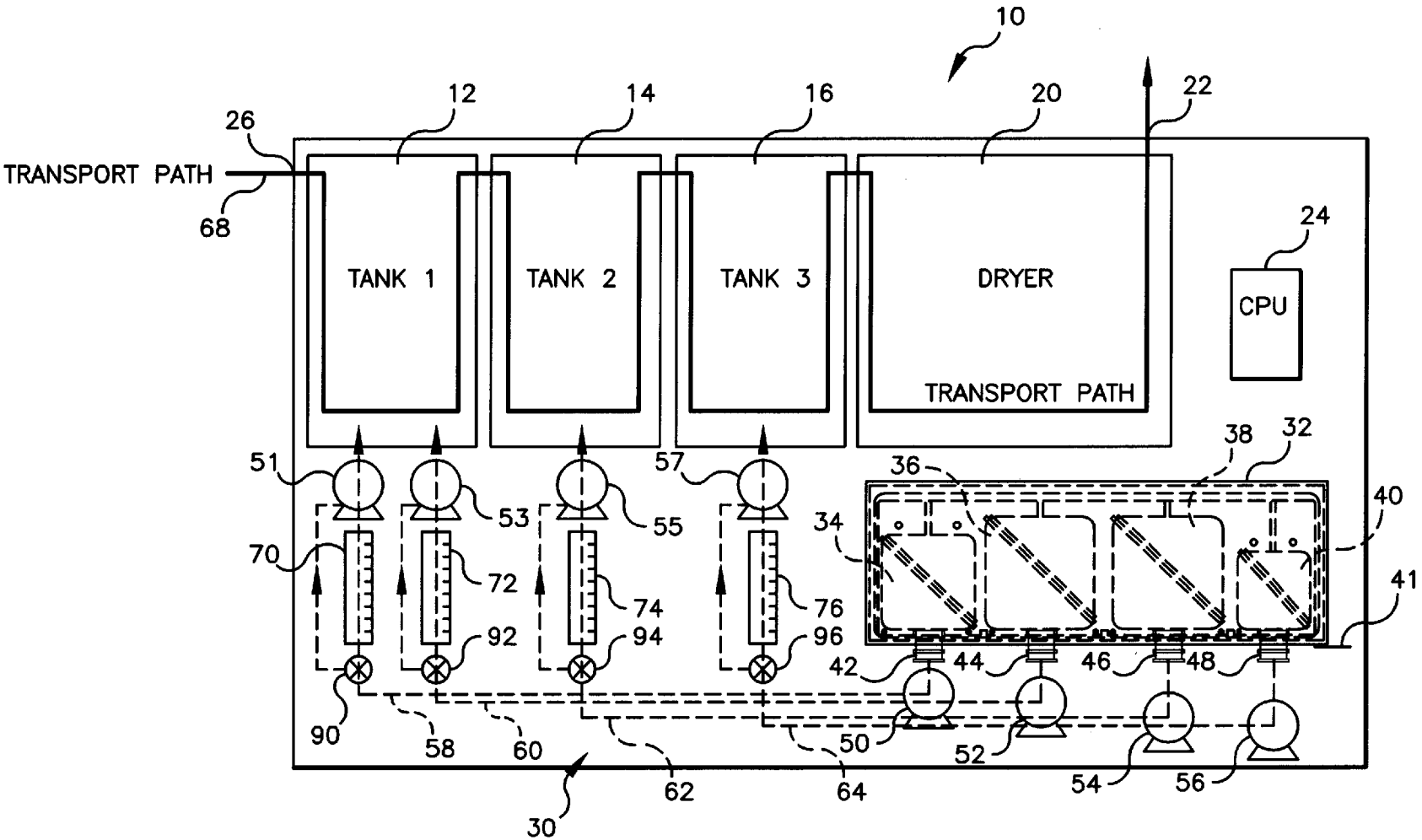
FIG. 1 is a diagram representation of the processing apparatus made in accordance with the present invention.

Referring to FIG. 1 there is illustrated an apparatus 10 made in accordance with the present invention. In the particular embodiment illustrated, the apparatus 10 is a stand alone processing apparatus for processing a photosensitive media such as film, paper etc. However, the apparatus 10 may be a part of a larger apparatus such as a mini-lab wherein images are also exposed onto a photosensitive media which is processed in a similar manner.

The apparatus 10 includes a plurality of processing tanks 12, 14 and 16 each designed to hold a processing solution. A processing path 18 is defined which passes through tanks 12, 14 and 16 along which a photosensitive media travels for processing of the media, such as photographic film and/or paper. The apparatus 10 also includes a dryer 20 wherein the media is dried. After the media has been dried it is delivered outside of the apparatus 10 through an appropriate outlet 22 as is conventionally done for further treatment (for example, but not limited to scanning, cutting, packaging, etc). In the particular embodiment illustrated, three processing tanks are provided. Processing tank 12 being a developer tank for containing a develop solution; tank 14 being bleach/fix tank for containing a bleach/fix processing solution, and processing tank 16 for holding a wash processing solution. It is of course to be understood that any desired number of processing tanks may be provided containing the appropriate processing solutions as may be required by the photosensitive media being processed.

A computer 24 is provided for controlling operation of the apparatus 10 as is conventionally done. Thus, appropriate computer programs are provided for controlling operations of the various components that are provided in apparatus 10 and for controlling the appropriate sequence of operation of the various components as required for processing the particular photosensitive media being processed. As is typical, the media enters the apparatus through inlet 26 and is transported along the processing path 18 and delivered outside of the apparatus 10 through outlet 22. The transport mechanism may be of any type suitable for transporting of the media, for example but not by way of limitation, roller assemblies.

The apparatus includes a replenishment and delivery system 30 for providing replenishment solution to each of the tanks 12, 14 and 16. In the particular embodiment illustrated, the apparatus is designed to receive a package 32 containing a plurality of individual discrete containers 34, 36, 38 and 40, each containing an appropriate replenishment solution to be used to replenishment the processing solution in each of the processing tanks 12, 14 and 16, respectfully. In the particular embodiment illustrated, the containers 34 and 36 are appropriate processing solutions that are to be measured and forwarded to the processing tank 12 whereas the processing solution in container 38 is to be provided to processing container 14 and processing solution in container 40 is to be provided to processing tank 16. As can be seen, containers 34, 36, 38 and 40 each contain a different amount of processing solution. This is because different amounts of processing solution are required for processing a predetermined amount of media that is being processed. Thus, the size and quantity of these processing containers are designed such that when fully empty each will provide the appropriate amount for replenishment of the respective processing solution for processing a predetermined amount of media.

The package 32 is placed on an appropriate support surface 41 Each of the containers 34, 36, 38 and 40 is provided with an appropriate valve assembly or connection 42, 44, 46 and 48, respectively, for allowing the processing solution to be emptied from each of the containers. In the particular embodiment illustrated, each container 34, 36, 38, and 40 are appropriately connected by a conduit to respective pumps 50, 52, 54 and 56. Each of the pumps 50, 52, 54 and 56 are, through respective appropriate conduits 58, 60, 62 and 64, are fluidly connected to respective retaining vessels 70, 72, 74 and 76 which are in turn are fluidly connected to respective pumps 80, 82, 84 and 86. Valves 90, 92, 94 and 96 are provided such that one valve is associated with the outlet 71, 73, 75 and 77 of each of the retaining vessels 70, 72, 74 and 76, respectively (see FIG. 2).

Each of the retaining vessels 70, 72, 74 and 76 are also provided with an associated sensing system for determining when a predetermined amount of processing solution has been supplied to the retaining vessel for use in controlling the dispensing of a predetermined amount of processing solution from the associated container to its respective associated processing tank.

In the particular embodiments illustrated the sensing system comprises a plurality of sensors associated with each of the retaining vessels 70, 72, 74, and 76. In particular, three sensors 102*a*, 102*b*, 102*c* 102*d*, 104*a*, 104*b*, 104*c*, 104*d* and 106*a*, 106*b*, 106*c* and 106*d* are associated with each of the respective retaining vessels 70, 72, 74 and 76. The subscripts "a, b, c and d" simply identify which of the associate retaining vessels the sensors are associated therewith. For example, subscript "a" indicates the sensors 102*a*, 104*a*, and 106*a* associated with retaining vessels 70, subscript "b" indicates the sensors 102*b*, 104*b*, and 106*b* are associated with vessel 72 and subscript "c" associates the sensors 102*c*, 104*c*, and 106*c* with retaining vessel 74 and subscript "d" indicates the sensors 102*d*, 104*d*, and 106*d* are associated with retaining vessel 76. The sensors 102*a–d*; 104*a–d*; and 106*a–d* are all connected by appropriate circuits to computer 24 for the providing of appropriate signals as discussed later herein. In the particular embodiment illustrated, three sensors 102, 104, and 106 are provided with respect to each of the retaining vessels 70, 72, 74 and 76. The sensors 102*a–d* is a reference sensor which allows for the operation of the other sensors. The sensors 104*a–d* provide a first reference point and the sensors 106*a–d* are provided at a second reference point.

Figure 2:
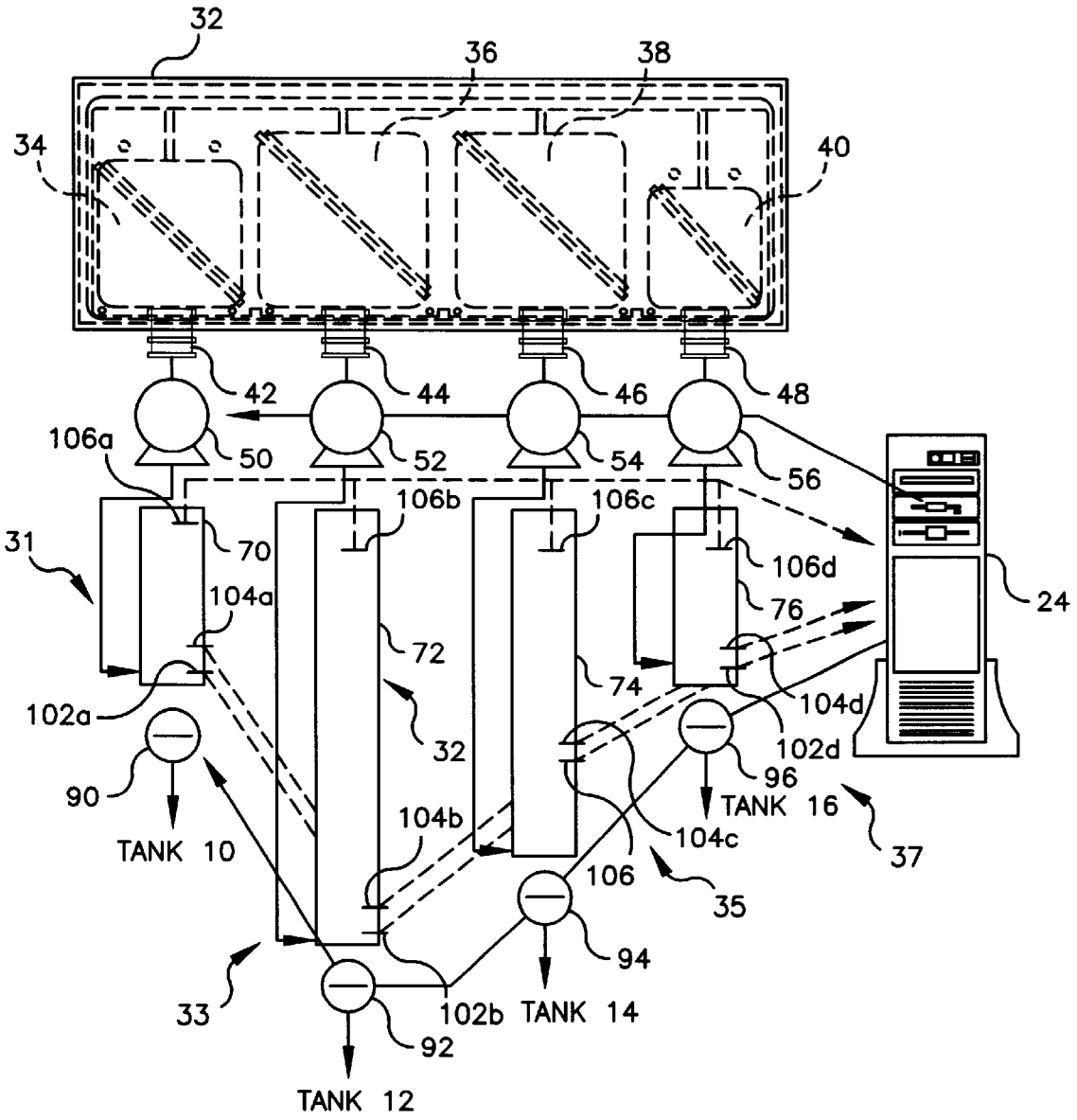
FIG. 2 is a schematic diagram of the delivery system of the apparatus of FIG. 1.
Figure 3:
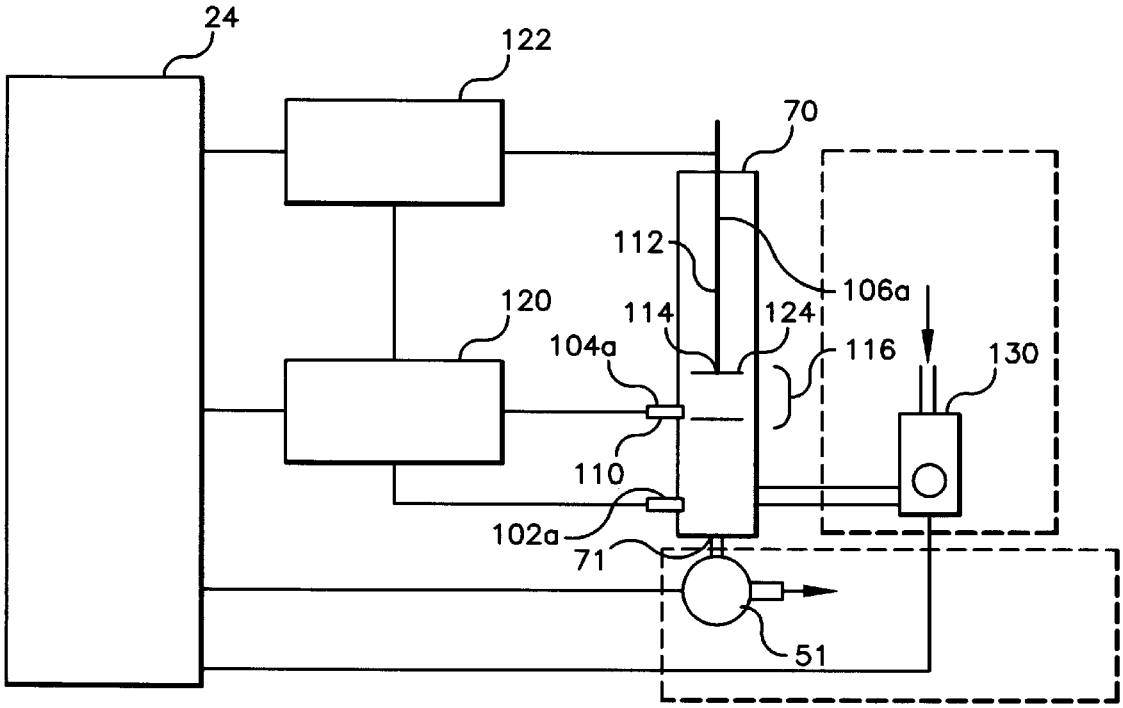
FIG. 3 is a schematic diagram of the delivery system for a single container and associated retaining vessel.

The replenishment and delivery system 30 for apparatus 10 in the embodiment illustrated in FIGS. 1 and 2 is made of four separate delivery systems 31, 33, 35, and 37. Reference is now made to FIG. 3 where there is illustrated one of the delivery system, in particular delivery system 31 for the associated with a container and the associated processing tank. For ease of understanding, a discussion will be provided with respect to one of the container and its associated processing tank. It being understood that the remaining processing containers and associated tanks operate in a similar manner. In particular, 102*a* is an electrode which can be used for determining the liquid level based on conductivity of the liquid within the retaining vessel 70. Likewise, the sensor 104*a* is also an electrode that provides a first measuring point 110. An adjustable electrode 106*a* is provided wherein the end 112 of the electrode provides a second measuring point 114 which defines a predetermined amount of replenishment solution between sensors 104*a* and 106*a* as indicated by the numerals 116. It is of course to be understood that the size of the retaining vessel and the distance which the sensors 104*a* and 106*a* are spaced apart will provide a predetermined amount of processing solution. In the preferred embodiment, the retaining vessel 70 is provided with calibration indicia so that the amount of liquid between the two sensors 104*a* and 106*a* can be directly read. Appropriate level sensing circuits 120, 122 are provided for providing information to computer 24. Initially, the retaining vessel 70 is filled with a predetermined amount of processing solution. This is accomplished by activating pump 50 the processing solution reaches the level indicated by numeral 124 within the container. The pump passes the processing solution through valve 130. However, valve 130 simply performs the function of allowing fluid flow from the associated container 34 to the retaining vessel 70. However, the pump 50 itself may serve as a valve. The processing solution is pumped from the container 34 until reaching the appropriate level 124. In embodiment illustrated the conductivity between the sensors 104*a* and 106*a* provided by the liquid extending between the two electrode produces a signal that advises the computer 24 that the liquid has been provided at the desired level. Once this level is reached, the pump 50 is stopped. When it is desired to deliver processing solution from the retaining vessel 70 to the associated processing tank, pump 51 is activated and it continues until the liquid level falls to the position indicated at point 110. This produces another signal which is sensed through use of the reference sensor 102*a* and the sensor 104*a*. Thus, based on the conductivity between these two electrodes the computer 24 can determine when the desired amount of processing solution has been provided to the processing tank. Once this has been done, the pump 51 is turned off stopping any further delivery. As can be seen, a precise metered amount will have been delivered to the processing tank. The refilling operation is again conducted as previously discussed by pumping in processing solution by pump 50 until the fluid once again contacts electrode 106*a* . As previously discussed level sensing circuits are provided for determining the appropriate conductivity between the appropriate sensors are reached thus providing the required information to the computer 24 for turning on and off the pumps and valves appropriately. The same procedure is provided for each of the associated containers, retaining vessels and tanks. The use of electrodes provided for precise metering of solution into and out of the retaining vessel 70 on a repeatable basis.

As can be seen, the adjustable sensor 106 can be raised or lowered to provide any desired predetermined amount and rate of dispensing of the processing solution from the container to the associated processing tank. This will of course be dependent upon the type of replenishment solution being supplied and the processing parameters of the processing solution within the processing tank.

Figure 4:
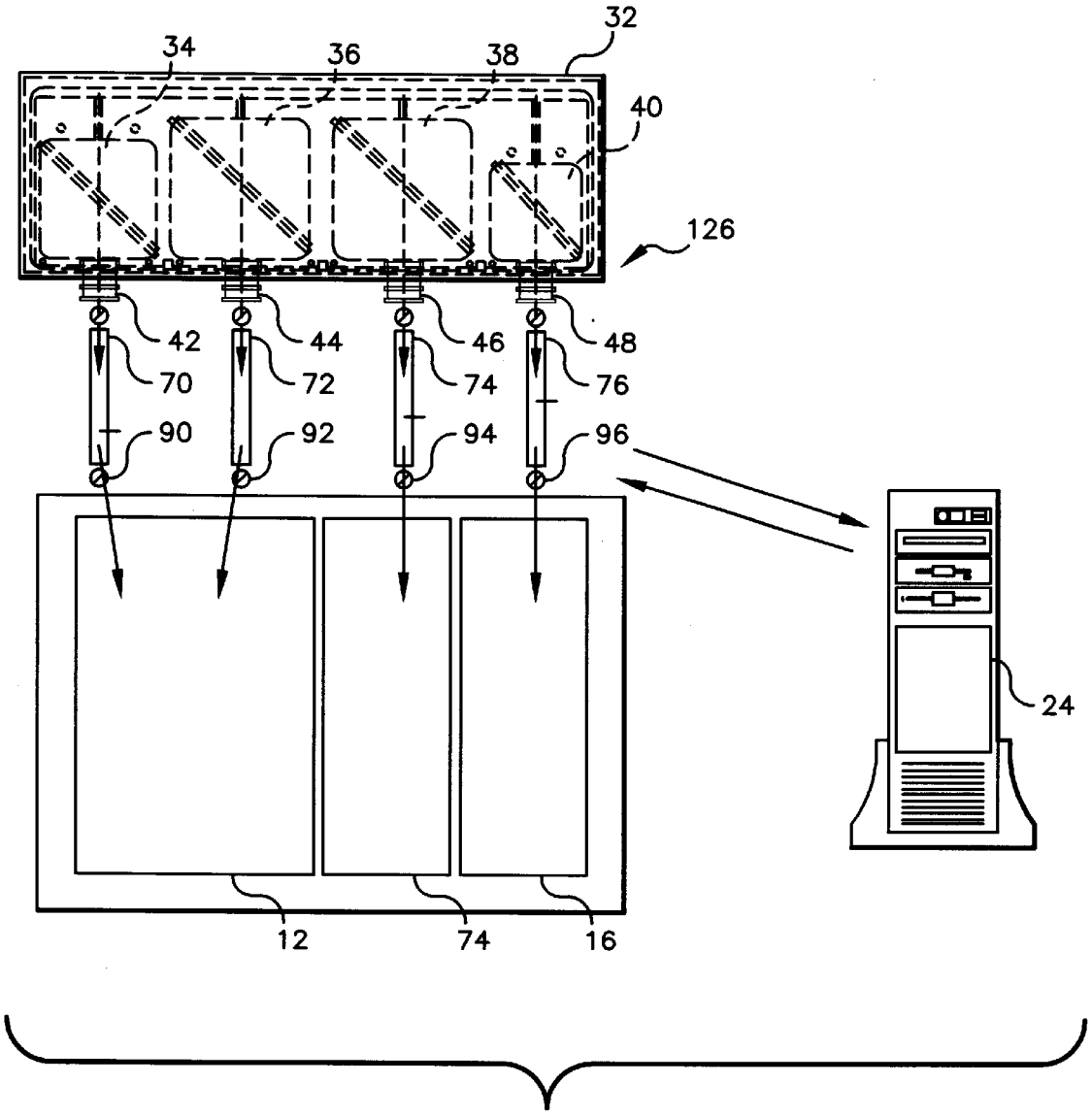
FIG. 4 is a schematic diagram of a modified delivery system made in accordance with the present invention.

Referring to FIG. 4, there is illustrated a modified delivery system 126 made in accordance with the present invention with like numerals indicating like parts and operation as previously discussed. In this particular embodiment, gravity is used for dispensing of the replenishment solution from the containers 34, 36, 38 and 40 into the processing tanks 12, 14 and 16. In this embodiment, only valves 42, 44, 46 and 48 are needed to supply processing solution to the retaining vessels as gravity is used to cause fluid to flow from the containers to their respective retaining vessel. Valves 90, 92, 94 and 96 control gravity flow from the retaining vessels to the respective tanks 12, 14 and 16 . The valves need only to be opened and closed as appropriate. The retaining vessels and associated sensors would operate in the same manner except in providing the flow by the pumps. This embodiment provides a less expensive delivery system.

Figure 5:
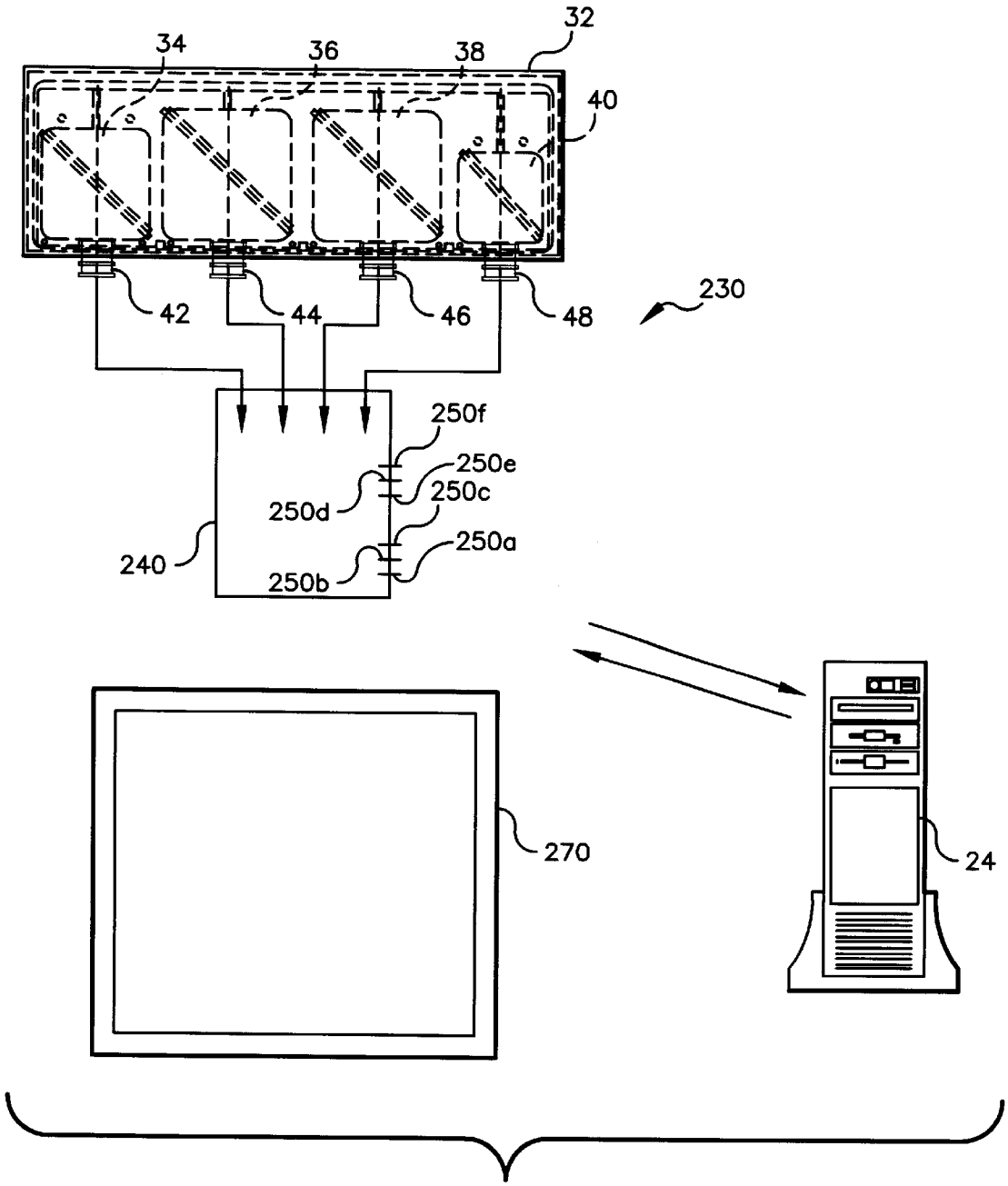
FIG. 5 illustrates yet another modified delivery system made in accordance with present invention.

Referring to FIG. 5 there is illustrated yet another modified delivery system 230 made in accordance with the present invention with like numerals indicated like parts and operation. In this particular embodiment, a single retaining vessel 240 is used in place of all of the retaining vessels 70, 72, 74 and 76 previously discussed and a single processing tank 270 is provided in place of the tanks 12, 14, and 16. In this embodiment additional sensors are provided in retaining vessel 240 as required for each of the processing solutions contained therein. Thus, in this embodiment, six sensors would be provided. Sensor 250*a* would be a reference sensor. Sensors 250*b*, 250*c*, 250*d*, 250*e* and 250*f* would each be associated with one of the containers provided. Thus, the sensors 250*b* and 250*c* would be used for providing the amount of processing solution from container 34 whereas sensors 250*c* and 250*d* would provide the appropriate amount of replenishment solution from container 36, sensors 250*d* and 250*e* would provide the appropriate amount of processing solution from container 38 and sensors 250*e* and 250*f* would provide the appropriate amount of processing solution from container 40. The positioning of each of these sensors can be adjustable so that the appropriate sensors are engaged for determining the appropriate delivery amount for each of the containers. In this embodiment, the process of replenishment solution from each of the containers 34, 36, 38 and 40 would be provided successively in turn as appropriate. Upon completion of providing all the replenishment solution desired then appropriate solution would be delivered to the single processing tank to which it is to be provided for.

In another form of the present invention there is provided means for visually viewing the retained vessels to see if the appropriate amount of processing solution has been delivered. In particular, a window may be provided for viewing only that portion of the retaining vessels that are necessary for viewing of the processing solution contained. The retaining vessels 70, 72, 74, and 76 are provided in an away from the light-tight environment of the processing tanks of the processor. The retaining vessels, as previously discussed can also be provided with calibration marks/indicia 160 for ease of quickly determining the amount of replenishment solution being provided. Also the calibration marks 160 can be used for adjusting the positioning of the appropriate sensors as desired for adjusting the amount of the processing solution to be delivered to the processing tank.

It is to be understood that various changes and modifications may be made. For example, while in the preferred embodiment electrodes are used for sensing of the liquid level, various other types of sensing devices can be used for determining the amount of replenishment solution provided in retaining vessels. For example, ultra sonic sensors could be used for determining the level of the processing solution within the retaining vessel. Any desired number may be provided for determining various different heights within the retaining vessel. If desired, float sensors could be used as an alternative. Any reliable type sensing system may be used for determining when the liquid level in the retaining vessel goes from a first reference point to a second reference point.

It is to be understood that various changes and modifications may be made without departing from the present invention, the present invention being defined by the following claims.

PARTS LIST

10 apparatus
12 processing tank
14 processing tank
16 processing tank
18 processing path
20 dryer
22 outlet
24 computer
26 inlet
30 delivery system
31 delivery system
32 package
34 delivery system
35 container
36 delivery system
37 container
38 delivery system
40 container
41 container
42 support surface
44 connection
46 connection
48 connection
50 connection
51 pump
52 pump
53 pump
54 pump
55 pump
56 pump
57 pump
58 conduit
60 conduit
62 conduit
64 conduit
70 retaining vessel
71 outlet
72 retaining vessel
73 outlet
74 retaining vessel
75 outlet
76 retaining vessel
77 outlet
80 pump
82 pump
84 pump
86 pump
90 valve
92 valve
94 valve
96 valve
102*a–d* sensor
104*a–d* sensor
106*a–d* sensor
110 first measuring point
112 end of electrode
114 second measuring point
116 amount of replenishment solution
120 sensing circuit
122 sensing circuit
124 level indicated within the container
126 modified delivery system
130 valve
160 calibration marks/indicia
230 modified delivery system
240 retaining vessel
270 processing tank
250*a–f* sensor

What is claimed is:

1. A photographic processor, comprising:

a processing tank for containing a processing solution through which a media is passed for processing of a media;

a delivery system for providing a replenishment solution to said processing tank from a package having at least two separate containers, each of said containers having a processing solution that is to be provided to said at least one processing tank, said delivery system substantially emptying each of said at least two separate containers in said package in an accurate predetermined rate so that all of said at least two containers in said package will be substantially empty at the same time, said delivery system having a retaining vessel, a liquid level sensing system for sensing a predetermined amount of said replenishment solution in said retaining vessel to be delivered to said processing tank, a delivery mechanism for filling and emptying said predetermined amount of replenishment solution from said retaining vessel in response to said liquid level sensing system.

2. A processor according to claim 1 wherein said liquid level sensing system comprises a pair of spaced sensors provided on said retaining vessel.

3. A processor according to claim 2 wherein each of said pair of spaced sensors comprises an electrode.

4. A processor according to claim 1 wherein said delivery system further comprises a pump associated with said retaining vessel for pumping solution from one of said containers into said retaining vessel.

5. A processor according to claim 4 wherein said delivery system further comprises a second pump associated with said retaining vessel for pumping solution from said retaining vessel to said processing tank.

6. A processor according to claim 1 wherein each of said processing solutions in each of said containers is to be delivered at a different rate.

7. A method for delivering a replenishment solution to a processing tank in a photographic processor having at least one processing tank and designed to provide replenishment solution to said at least one processing tank from a package having a plurality of containers each having a processing solution therein, comprising the steps of:

dispensing said processing solutions from each of said containers into an associated retaining vessel until a signal to stop is received; and dispensing a predetennined amount of said processing solution from said retaining vessel for delivery to one of said processing tanks.

8. A method according to claim 7 further comprising the step of:

successively dispensing processing solutions from at least two of said containers into one of said associated vessels prior to being dispensed to said at least one processing tank.

9. A method according to claim 7 wherein a plurality of retaining vessels are provided, each of said retaining vessels being associated with at least one of said containers.

10. A photographic processor, comprising:

a plurality of processing tanks for containing a processing solution through which a media is passed for processing of a media;

a delivery system for providing a replenishment solution to said plurality of processing tanks from a package having at least two separate containers, each of said containers having a processing solution that is to be provided to one said plurality of processing tanks, said delivery system substantially emptying each of said at least two separate containers in said package in an accurate predetermined rate so that said at least two containers in said package will be substantially empty at the same time, said delivery system having a retaining vessel, a liquid level sensing system for sensing a predetermined amount of said replenishment solution in said retaining vessel, a delivery mechanism for filling and emptying said predetermined amount of replenishment solution from said retaining vessel in response to said liquid level sensing system.

11. A processor according to claim 10 wherein said liquid level sensing system comprises a pair of spaced sensors provided on said retaining vessel.

12. A processor according to claim 11 wherein each of said pair of spaced sensors comprises an electrode.

13. A processor according to claim 10 wherein said delivery system further comprises a pump associated with said retaining vessel for pumping solution from one of said containers into said retaining vessel.

14. A processor according to claim 13 wherein said delivery system further comprises a second pump associated with said retaining vessel for pumping solution from said retaining vessel to said processing tank.

15. A processor according to claim 10 wherein each of said processing solutions in each of said containers is to be delivered at a different rate.

16. A processor according to claim 10 wherein said liquid level sensing system comprises a plurality of spaced sensors provided on said retaining vessel such that at least two different processing solutions can be accurately delivered to and from said retaining vessel.

17. A delivery system for providing a replenishment solution to one or more processing tanks from a package having at least two separate containers, each of said containers having a processing solution that is to be provided to said one or more processing tanks, said delivery system substantially emptying each of said at least two separate containers in said package in an accurate predetermined rate so that all of said at least two containers into said package will be substantially empty at the same time, said delivery system having a retaining vessel, a liquid level sensing system for sensing a predetermined amount of said replenishment solution in said retaining vessel to be delivered to said one or more processing tanks, a delivery mechanism for filling and emptying said predetermined amount of replenishment solution from said retaining vessel in response to said liquid level sensing system.

18. A delivery system according to claim 17 wherein said liquid level sensing system comprises a pair of spaced sensors provided on said retaining vessel.

19. A delivery system according to claim 18 wherein each of said pair of spaced sensors comprises an electrode.

20. A delivery system according to claim 17 wherein said delivery system further comprises a pump associated with said retaining vessel for pumping solution from one of said containers into said retaining vessel.

21. A delivery system according to claim 20 wherein said delivery system further comprises a second pump associated with said retaining vessel for pumping solution from said retaining vessel into said processing tank.

22. A delivery system according to claim 17 wherein each of said processing solutions in each of said containers is to be delivered at a different rate.

* * * * *